United States Patent [19]

Clarke

[11] Patent Number: 4,741,435

[45] Date of Patent: May 3, 1988

[54] PACKAGE ASSEMBLY INCLUDING A TRANSPARENT SLEEVE HAVING LOCKING FLANGES

[75] Inventor: Edwin B. Clarke, Bala Cynwyd, Pa.

[73] Assignee: Budge Manufacturing Co., Inc., Pennsauken, N.J.

[21] Appl. No.: 20,506

[22] Filed: Mar. 3, 1987

[51] Int. Cl.[4] ..... B65D 5/38

[52] U.S. Cl. ..... 206/45.33; 229/19; 229/23 BT; 229/162

[58] Field of Search ..... 206/45.31, 45.33; 229/9, 11, 19, 20, 23 BT

[56] References Cited

U.S. PATENT DOCUMENTS

| | | | |
|---|---|---|---|
| 2,317,040 | 4/1943 | Ethridge | 229/9 |
| 2,445,034 | 7/1948 | Moore | 229/19 |
| 2,686,627 | 8/1954 | McElwee | 229/19 |
| 2,722,361 | 11/1955 | Kindseth | 229/9 |
| 2,790,589 | 4/1957 | Moore | 206/45.33 |
| 2,936,944 | 5/1960 | Moore | 229/9 |
| 2,954,914 | 10/1960 | Herlihy | 229/52 B |
| 3,131,849 | 5/1964 | Paige | 229/9 X |
| 3,302,844 | 2/1967 | Henry | 229/19 |
| 3,648,831 | 3/1972 | Arnone | 229/9 X |
| 3,741,387 | 6/1973 | Whitecar | 229/19 X |

*Primary Examiner*—Stephen Marcus
*Assistant Examiner*—Bryon Gehman
*Attorney, Agent, or Firm*—Eugene E. Renz, Jr.

[57] ABSTRACT

A package assembly comprising a main container portion having an open side, a tubular sleeve member of transparent material engageable over the container portion and locking flanges for detaching mounting the sleeve member on the main container portion.

2 Claims, 3 Drawing Sheets

FIG. 6
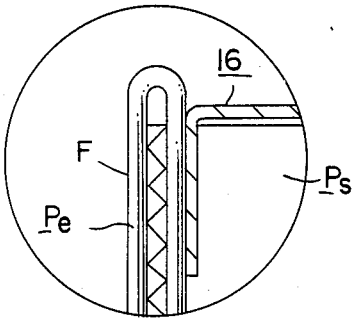
FIG. 7
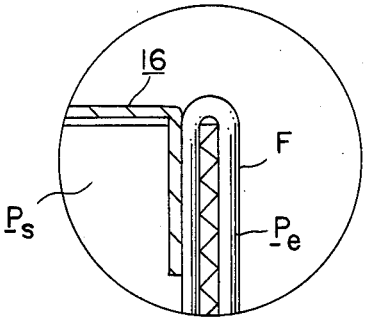
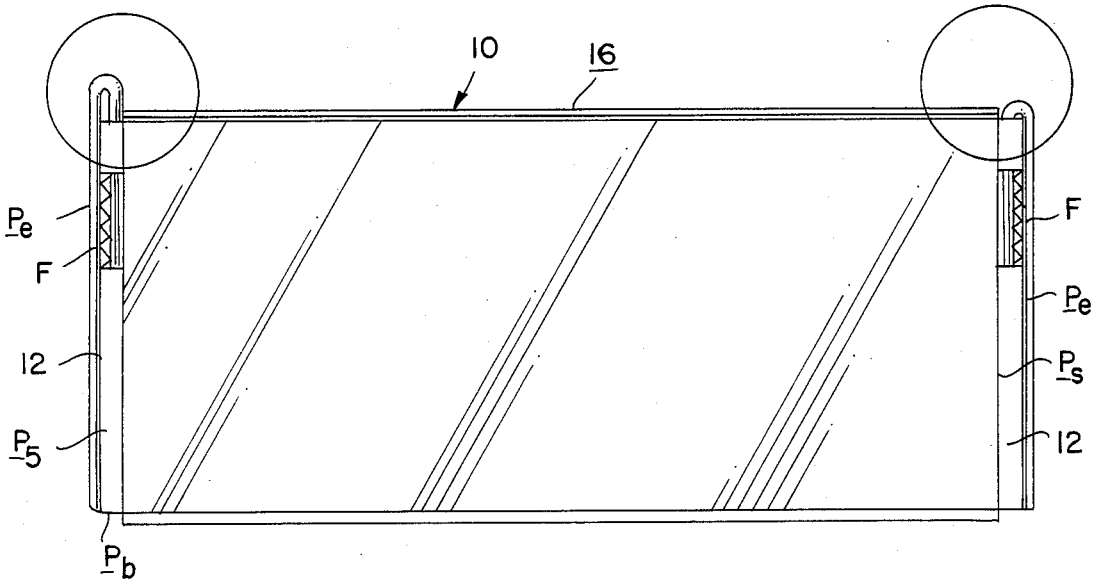
FIG. 5

PACKAGE ASSEMBLY INCLUDING A TRANSPARENT SLEEVE HAVING LOCKING FLANGES

FIELD OF THE INVENTION

The present invention relates to a new and useful improvement in packaging assembly.

BACKGROUND OF THE INVENTION

Package assemblies of the type to which the present invention relates are typically used by manufactures to house manufactured products and protect them during shipment and storage. Typically, these package assemblies comprise a carton of box-like forms made of cardboard which is usually in the form of a package simply by folding the blank along the score lines. These containers also utilize interengaging locking tabs and slotted openings which are designed to register when the panels of the box blank are manipulated in a predetermined sequence and fashioned to form the box. In some cases, the package assemblies comprise cartons made of a clear plastic material, so the container contents are readily visible to the purchaser.

SUMMARY OF THE INVENTION

The package assembly of the present invention is characterized by novel features of construction and arrangement permitting a visual and tactile inspection of the container contents without disassembling or opening the package assembly. The package assembly is of a relatively simple design which is easy and economical to manufacture and can be assembled from a blank in a quick and easy fashion. The package assembly essentially comprises a box-like main container having an open side and a tubular sleeve made of a transparent material such as plastic, which telescopes over the container and has a unique locking arrangement to support the sleeve in an assembled position. The package assembly of the present invention has the advantage of the clear, see-through-package type of the prior art and yet is of very stable construction, unlike the prior flimsy plastic containers. This feature is important and facilitates necessary stacking of the package assembly during shipment and storage. In other words, for economy, the package assembly must be capable of stacking one on top of another without collapsing.

BRIEF DESCRIPTION OF THE DRAWINGS

These and other objects of the present invention and the various features and details of the operation and construction thereof are hereinafter more fully set forth with reference to the accompanying drawings, wherein:

FIG. 5 is a side elevational view similar to FIG. 4 showing the transparent sleeve fully assembled over the box to secure the contents in place;

FIGS. 6 and 7 are enlarged fragmentary sectional views showing the relationship of the sleeves and the box elements to hold the sleeve in place.

DETAILED DESCRIPTION OF THE PREFERRED EMBODIMENT

Figure 1:
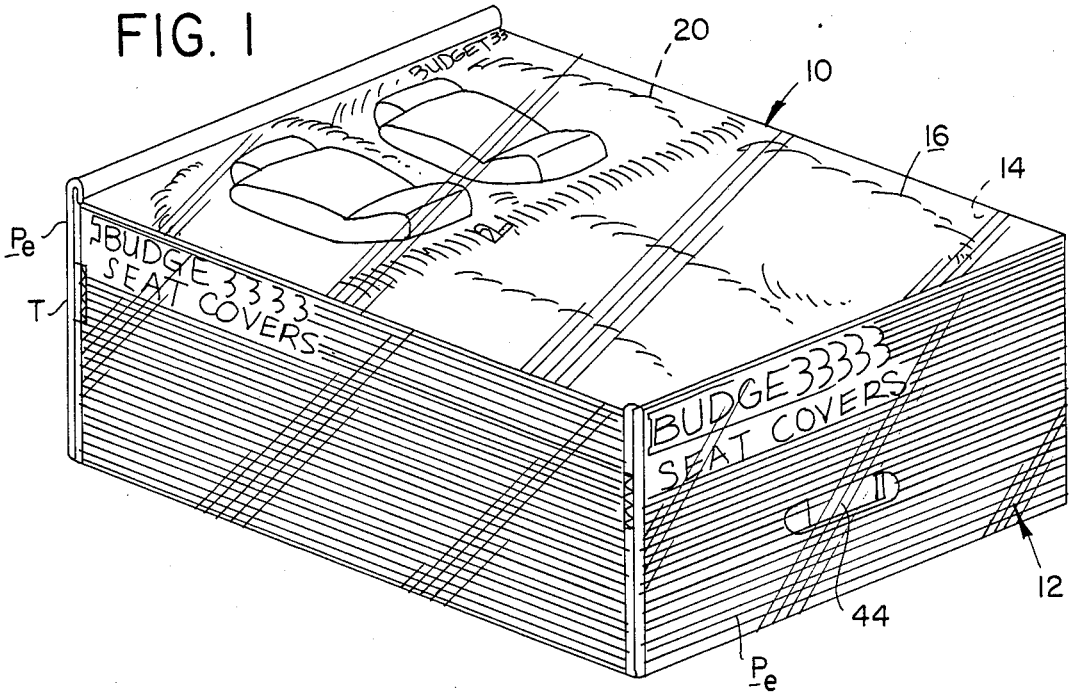
FIG. 1 is a perspective view of package assembly in accordance with the present invention.

Referring now to the drawing and particularly FIG. 1 thereof, there is shown a fully assembled package made in accordance with the present invention generally designated by the numeral 10. As illustrated, the package comprises a box-like main container portion 12 having an open side 14 and a tubular sleeve 16 which telescopes over the box to hold the contents of the container in place. The sleeve is preferably of a transparent material such as clear plastic to permit visual examination of the contents of the container generally designated by the numeral 20.

Figure 2:
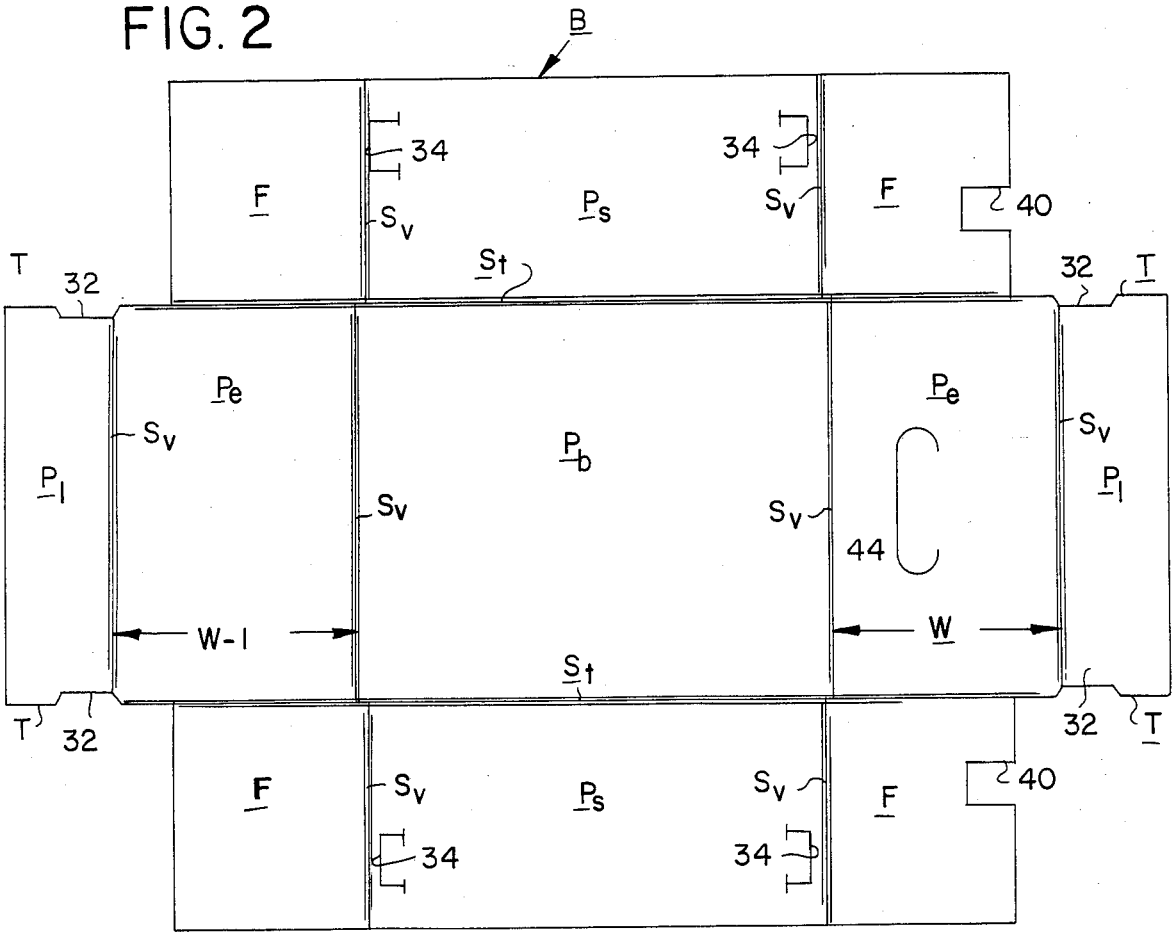
FIG. 2 is a plan view of a pre-scored blank from which the carton may be assembled.

FIG. 2 is a view of the box blank B from which the main container is formed. As illustrated, the box blank may be made of relatively stiff paperboard product such as cardboard or the like, and comprises a series of rectangular panels P separated by a series of parallel score lines $S_v$. The rectangular panels form the end panels $P_e$ and a bottom panel $P_b$ for the completely assembled container as shown in FIG. 1. Score lines $S_t$ extend transversely to the vertical score lines $S_v$ to define the side panels $P_s$.

Two small rectangular panels $P_l$ project from the end panels $P_e$ which have recessed cuts 32 along their side edges defining locking tabs T, which engage in slotted openings 34 to support the main box-like container in the assembled relation shown in FIG. 1. Each side panel $P_s$ has closure flaps F extending therefrom and a slotted opening 34 adjacent to score line $S_v$ which, in the assembled box, define keeper slots for receiving the locking tabs which will be described in more detail hereafter when discussing the assembly of the box blank to form the finished container. Note that each side flap F projecting from one side edge of one of the side panels $P_s$ has a rectangular cut-out 40 which defines an elongated rectangular opening, which in turn registers with a slotted hand grip portion 44 in the end panel.

Figure 3:
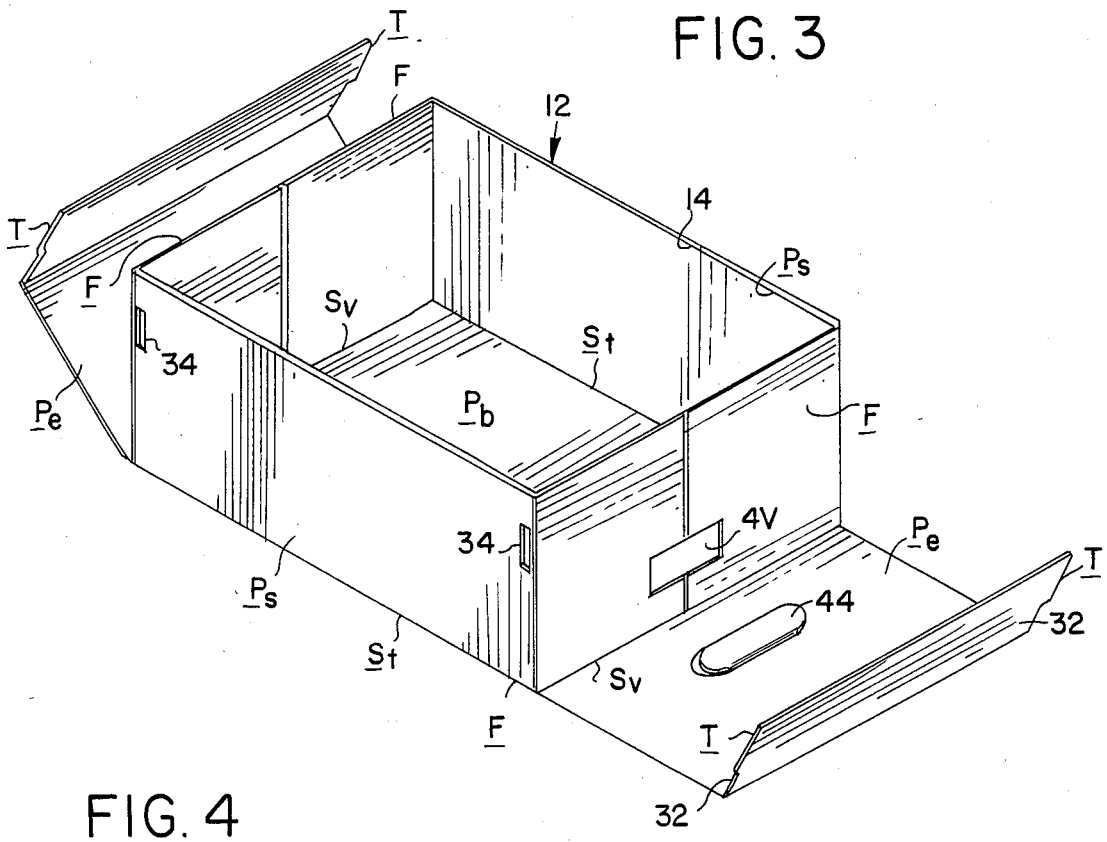
FIG. 3 is a perspective view showing the container in a partially assembled condition.
Figure 4:
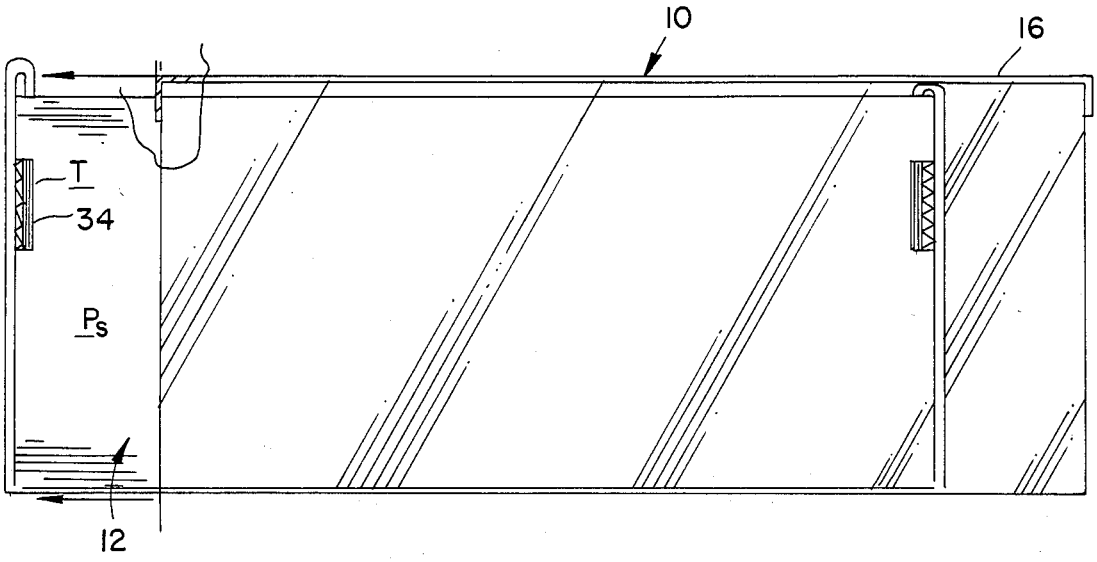
FIG. 4 is an enlarged side elevational view showing assembly of the transparent outer sleeve assembled to the main box portion.

Consider now assembly of the blank made in accordance with the present invention. The blank B is supported on its bottom panel $P_b$. First the side panels $P_s$ are folded about the score line $S_t$ to a position perpendicular to the bottom panel $P_b$ as shown in FIG. 3 and the end flaps F are folded inwardly to align with the vertical score line $S_v$ separating the bottom panel $P_b$ and the end panels $P_e$. In this position, the end panels $P_e$ are folded inwardly about their respective score lines. The retention flaps $P_1$ are then folded inwardly so the locking tabs T align with the openings 34 and then they are snapped in place to secure all of the panels in the assembled relation shown. Note that the locking tabs T flex slightly until they align with the openings 34 and then snap into place. The handle flap 44 is then pressed inwardly to engage under the one edge of the rectangular opening 42 to further lock the one end panel in place. Note that the width W of the end panel at the handle end is somewhat less than the width $W_1$ of the opposing end panel, so the end panel at this end when assembled projects slightly above the plane P—P of the upper edge of the side panels in the manner shown in FIG. 4.

The main box assembly may now be filled with product. After product is placed in the box, the elongated rectangular sleeve 16 is telescoped over the short end of the box from the direction shown in FIG. 4. The sleeve 16 has a large rectangular top panel $16_a$ which overlies the open end of the container and two inwardly directed locking flanges $16_b$, $16_b$ which in the assembled relation abut and are closely adjacent the inner face of the end panels to hold the sleeve in place.

The package assembly of the present invention has many features and advantages over prior art. For example, the container is comprised of relatively few parts which are easy and economical to make and assemble. Moreover, the unique configuration of the combination allows visual inspection of the container contents thereby presenting an attractive display assembly. Even though one side is simply comprised of the see-through plastic liner, the container is configured in such a manner that it has great strength or a plurality can be stacked one on top of the other without damage. This is important for shipment and storage. Another feature is the fact that the container has access means to permit tactile feeling of the goods without opening the carton.

Even though a specific embodiment of the invention has been illustrated and described herein, it is not intended to limit the invention and changes and modifications may be made therein within the scope of the following claims.

What is claimed is:

1. A package assembly comprising a main container having an open side and including a pair of spaced parallel side walls of a predetermined height and a pair of end walls located at opposite ends of said side walls, one of said end walls being of the same height as said side walls and the other end wall projecting above the plane of the open side to define an abutment surface, a tubular sleeve member of transparent material engageable over the container portion and having one panel of generally the same peripheral dimensions of the open side of said main container, and a pair of inwardly directed flexible flanges at opposite edges of said one panel of said sleeve member confronting the open side of the container, said flanges extending the full width of said end walls and being perpendicular to said one panel, the flange at one end abutting the abutment surface in the assembled relation and the flange at the other end engaging inboard of the opposite end wall to secure said sleeve member on the container.

2. A package assembly comprising a main container portion having an open side and including a pair of spaced parallel side walls of a predetermined height and a pair of end walls located at opposite ends of said side walls, that one of said end walls being of the same height as said walls and the other end wall projecting above the plane of the open side to define an abutment surface, a tubular sleeve member of transparent material engageable over the container portion and having a pair of inwardly directed flexible flanges at opposite edges of one panel of said sleeve member confronting the open side of the container, the flange at one end abutting the abutment surface in the assembled relation and the flange at the other end engaging inboard of the opposite end wall to secure said sleeve member on the container, a pair of side flaps projecting from one side edge of one of said side walls having cut-outs in confronting edges which define an elongated rectangular opening and a hand-grip portion in the end wall which register with said opening.

* * * * *